US008554124B2

(12) United States Patent
Lee et al.

(10) Patent No.: US 8,554,124 B2
(45) Date of Patent: Oct. 8, 2013

(54) PRINTING MEDIUM FEEDING APPARATUS AND IMAGE FORMING APPARATUS HAVING THE SAME

(75) Inventors: Jin-soo Lee, Suwon-si (KR); Hoon Kang, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1049 days.

(21) Appl. No.: 11/956,781

(22) Filed: Dec. 14, 2007

(65) Prior Publication Data

US 2008/0145128 A1 Jun. 19, 2008

(30) Foreign Application Priority Data

Dec. 19, 2006 (KR) ..... 10-2006-0130387

(51) Int. Cl.
*B65H 9/06* (2006.01)
*B65H 3/44* (2006.01)

(52) U.S. Cl.
USPC ..... 399/391; 399/395; 399/392; 271/245

(58) Field of Classification Search
USPC ..... 400/632, 632.1, 579; 271/245, 246; 399/372, 395, 391, 392
See application file for complete search history.

(56) References Cited

U.S. PATENT DOCUMENTS

| | | | | |
|---|---|---|---|---|
| 4,921,241 | A | 5/1990 | Landa et al. | |
| 6,011,948 | A * | 1/2000 | Amano et al. | 399/395 |
| 6,644,875 | B1 * | 11/2003 | Sakaino et al. | 400/579 |
| 6,805,509 | B2 | 10/2004 | Ahn | 400/709 |
| 7,308,227 | B2 * | 12/2007 | Ahn | 399/388 |
| 2004/0028438 | A1 | 2/2004 | Shin | |
| 2005/0002688 | A1 * | 1/2005 | Jeong et al. | 399/110 |
| 2006/0120781 | A1 * | 6/2006 | Ha et al. | 399/395 |

FOREIGN PATENT DOCUMENTS

| | | | | |
|---|---|---|---|---|
| DE | 3912458 | A1 * | 11/1989 | B65H 9/06 |
| EP | 0 782 967 | A1 | 7/1997 | |
| EP | 1 914 599 | A1 | 4/2008 | |
| JP | 59138548 | A * | 8/1984 | B65H 9/06 |
| JP | 01-317947 | A | 6/1988 | |
| JP | 6-191686 | | 7/1994 | |
| JP | 7-228384 | | 8/1995 | |
| JP | 2002-087644 | A | 9/2000 | |

(Continued)

OTHER PUBLICATIONS

Korean Notice of Allowance mailed Aug. 20, 2012 issued in corresponding Korean Patent Application No. 10-2006-0130387.

(Continued)

*Primary Examiner* — Daniel J Colilla
(74) *Attorney, Agent, or Firm* — Staas & Halsey LLP

(57) ABSTRACT

A printing medium feeding apparatus includes a feeding part which feeds a printing medium, and a printing medium aligning roller part which aligns a leading edge of the printing medium fed from the feeding part and transfers the aligned printing medium to an image forming part which forms an image on the printing medium, wherein the printing medium aligning roller part comprises a pair of rollers which transfer the printing medium to the image forming part, and an aligning shutter which is rotationally coupled to at least one of the pair of rollers, which rotates when the leading edge of the printing medium contacts the aligning shutter with a pressure greater than a reference pressure in a reference direction and guides the leading edge of the printing medium fed from the feeding part toward the reference direction.

12 Claims, 11 Drawing Sheets

(56) References Cited

FOREIGN PATENT DOCUMENTS

| | | | | | |
|---|---|---|---|---|---|
| JP | 2000309449 | A | * | 11/2000 | ..... B65H 9/06 |
| JP | 2004-354422 | | | 12/2004 | |
| JP | 2005154073 | A | * | 6/2005 | ..... B65H 9/10 |
| KR | 2004-14858 | | | 2/2004 | |
| KR | 2005-87262 | | | 8/2005 | |
| KR | 10-2006-0063202 | A | | 6/2006 | |

OTHER PUBLICATIONS

European Office Action mailed Mar. 21, 2013 in corresponding European Patent Application No. 07123405.8.

* cited by examiner

PRINTING MEDIUM FEEDING APPARATUS AND IMAGE FORMING APPARATUS HAVING THE SAME

CROSS-REFERENCE TO RELATED APPLICATION

This application claims the benefit of Korean Application No. 2006-130387, filed Dec. 19, 2006, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image forming apparatus having an improved printing medium feeding apparatus.

2. Description of the Related Art

In general, an image forming apparatus prints image data on a printing medium, such as a sheet of paper, a transparency sheet, etc., according to a printing signal transmitted from a host apparatus. The image forming apparatus may perform a variety of functions, such as a scanning function to scan a document and generate image data corresponding to the document, an e-mail transmitting function to transmit image data to an e-mail account through an e-mail server, a facsimile transmitting function to transmit image data of a document to an external facsimile machine through a modem, and a copying function to copy image data of a document onto a printing medium or a plurality of printing media. Recently, image forming apparatuses have been designed as multifunctional devices which perform two or more of the above-described functions simultaneously for the convenience of a user or users.

In general, the image forming apparatus includes a feeding part to feed the printing medium onto a feeding path, an image forming part to apply developer or ink on the printing medium to form an image, and a discharging part to discharge the printing medium outside of the image forming apparatus.

FIG. 1A is a schematic view illustrating a configuration of a conventional image forming apparatus 10. As shown in FIG. 1A, the conventional image forming apparatus 10 includes a feeding cassette 20 in which sheets of printing media are stored, a pick-up roller 40 which picks up individual sheets of the printing media from the feeding cassette 20, a paper aligning roller part 50 which aligns a leading edge of a printing medium picked up by the pick-up roller 40 and transfers the aligned printing medium to an image forming part 60, and a casing 70.

As shown in FIG. 1B, the paper aligning roller part 50 includes a pair of transferring rollers 51 and 53 which transfer the printing medium picked up by the pick-up roller 40 to the image forming part 60, and a shutter 55 which is coupled to a rotational shaft with the transferring roller 51. The shutter 55 has a protruding part 55*a* which rotates according to pressure from the printing medium picked up by the pick-up roller 40 and moving along a feeding path. The shutter 55 contacts the printing medium as the printing medium is being transferred to the image forming part 60 and aligns a leading edge of the printing medium before the transferring rollers 51 and 53 contact the printing medium. The shutter 55 applies a repulsive force to the printing medium to uniformly align the leading edge of the printing medium before the pressure of the moving printing medium exceeds a reference pressure.

The shutter 55 rotates at a predetermined angle if the leading edge of the printing medium is uniformly aligned and the pressure applied to the shutter 55 by the leading edge of the moving printing medium exceeds the reference pressure. Accordingly, the printing medium enters between the transferring rollers 51 and 53 with an aligned leading edge.

However, in the conventional image forming apparatus 10 having the paper aligning roller part 50 described above and shown in FIG. 1B, the printing medium does not always press the protruding part 55*a* at the same angle. Instead, the printing medium may press the shutter 55 at a center angle indicated by the arrow "c", an external angle in a direction indicated by the arrow "a" pointing away from the transferring roller 51, an internal angle in a direction indicated by the arrow "b" pointing towards the transferring roller 51, or another angle.

If the printing medium presses the shutter 55 at a center angle "c", the shutter 55 rotates and properly aligns the leading edge of the printing medium when the pressure applied by the moving printing medium exceeds the reference pressure. However, the shutter 55 may rotate even when a smaller pressure than the reference pressure is applied by the moving printing medium when the printing medium presses the shutter 55 at the external angle "a". In this case, a problem occurs when the printing medium enters between the transferring rollers 51 and 53 before the leading edge of the printing medium is aligned, because the printing medium moves to the image forming part 60 in an unaligned state. Accordingly, when the unaligned leading edge of the printing medium is transferred to the image forming part 60, printing quality decreases.

Also, if the printing medium presses the internal side of the shutter 55 at the internal angle represented by the arrow "b" in FIG. 1B, the shutter 55 does not rotate at all. In this case, the paper aligning roller part 50 fails to transfer the printing medium to the image forming part 60, resulting in a paper jam even if the printing medium contacts the shutter 55 with a larger pressure than the reference pressure.

Meanwhile, the above-described problems become even more serious if the image forming apparatus 10 has a plurality of feeding parts to transfer multiple sheets of the printing media from different directions and angles. Specifically, the range of angles at which the sheets of the printing media contact the shutter 55 further increases, resulting in a further decrease in printing quality and more paper jams.

SUMMARY OF THE INVENTION

Accordingly, an aspect of the present invention provides a paper feeding apparatus which can smoothly align a leading edge of a printing medium fed from a feeding part and an image forming apparatus having the same.

According to an aspect of the present invention, a paper feeding apparatus includes a feeding part which feeds a printing medium, and a printing medium aligning roller part which aligns a leading edge of the printing medium fed from the feeding part and transfers the aligned printing medium to an image forming part which forms an image on the printing medium, wherein the printing medium aligning roller part comprises a pair of rollers which transfer the printing medium to the image forming part, and an aligning shutter which is rotationally coupled to one of the pair of rollers, rotates according to whether the printing medium contacts the aligning shutter with a pressure greater than a reference pressure in a reference direction, and guides the leading edge of the printing medium fed from the feeding part toward the reference direction.

According to an aspect of the invention, the feeding part includes a plurality of feeding cassettes which feed the printing medium and other printing media from different directions to the printing medium aligning roller part.

According to an aspect of the invention, the aligning shutter includes a shutter main body which is rotationally coupled to a rotational shaft of the roller to which the aligning shutter is rotationally coupled to, a guiding surface which protrudes from one side of the shutter main body to contact the leading edge of the printing medium and guide the leading edge of the printing medium in the reference direction, and an elastic member which applies the reference pressure to the shutter main body so that the shutter main body rotates around the rotational shaft of the roller according to whether the pressure of the printing medium applied to the guiding surface exceeds the reference pressure.

According to an aspect of the invention, the guiding surface has a recessed shape so that the leading edge of the printing medium is guided in the reference direction by the recessed shape.

According to an aspect of the invention, the guiding surface has a curved or a polygonal sectional shape.

According to another aspect of the present invention, an image forming apparatus includes a printing medium feeding apparatus including a feeding part which feeds a printing medium, and a printing medium aligning roller part which aligns a leading edge of the printing medium fed from the feeding part and transfers the aligned printing medium to an image forming part which forms an image on the printing medium, wherein the printing medium aligning roller part includes a pair of rollers which transfer the printing medium to the image forming part, and an aligning shutter which is rotationally coupled to one of the pair of the rollers, rotates according to whether the printing medium contacts the aligning shutter with a pressure greater than a reference pressure in a reference direction, and guides the leading edge of the printing medium fed from the feeding part toward the reference direction, the image forming part which forms the image on the printing medium fed from the printing medium feeding apparatus, and a discharging part which discharges the printing medium on which the image is formed to an outside of the image forming apparatus Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
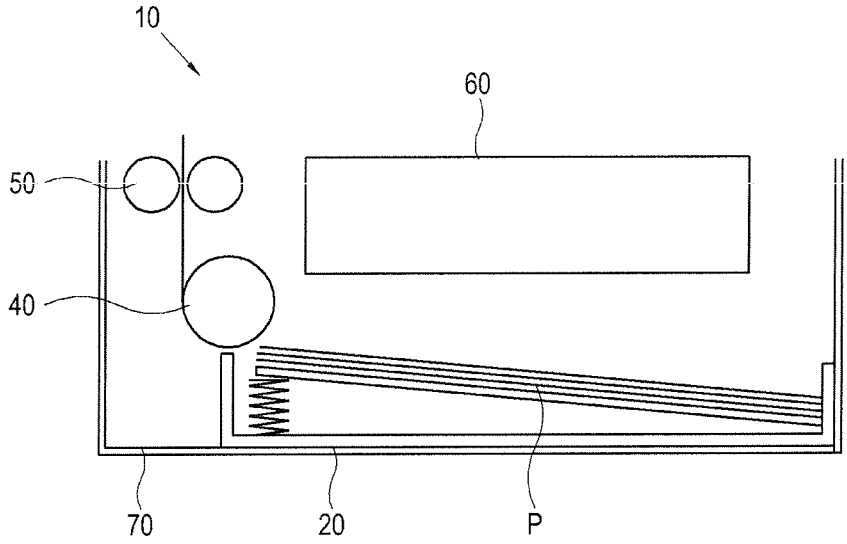
FIG. 1A (RELATED ART)
FIG. 1A is a schematic view illustrating a configuration of a conventional feeding apparatus.

Reference will now be made in detail to the present embodiments of the present invention, examples of which are illustrated in the accompanying drawings, wherein like reference numerals refer to like elements throughout. The embodiments are described below so as to explain the present invention by referring to the figures.

Figure 2:
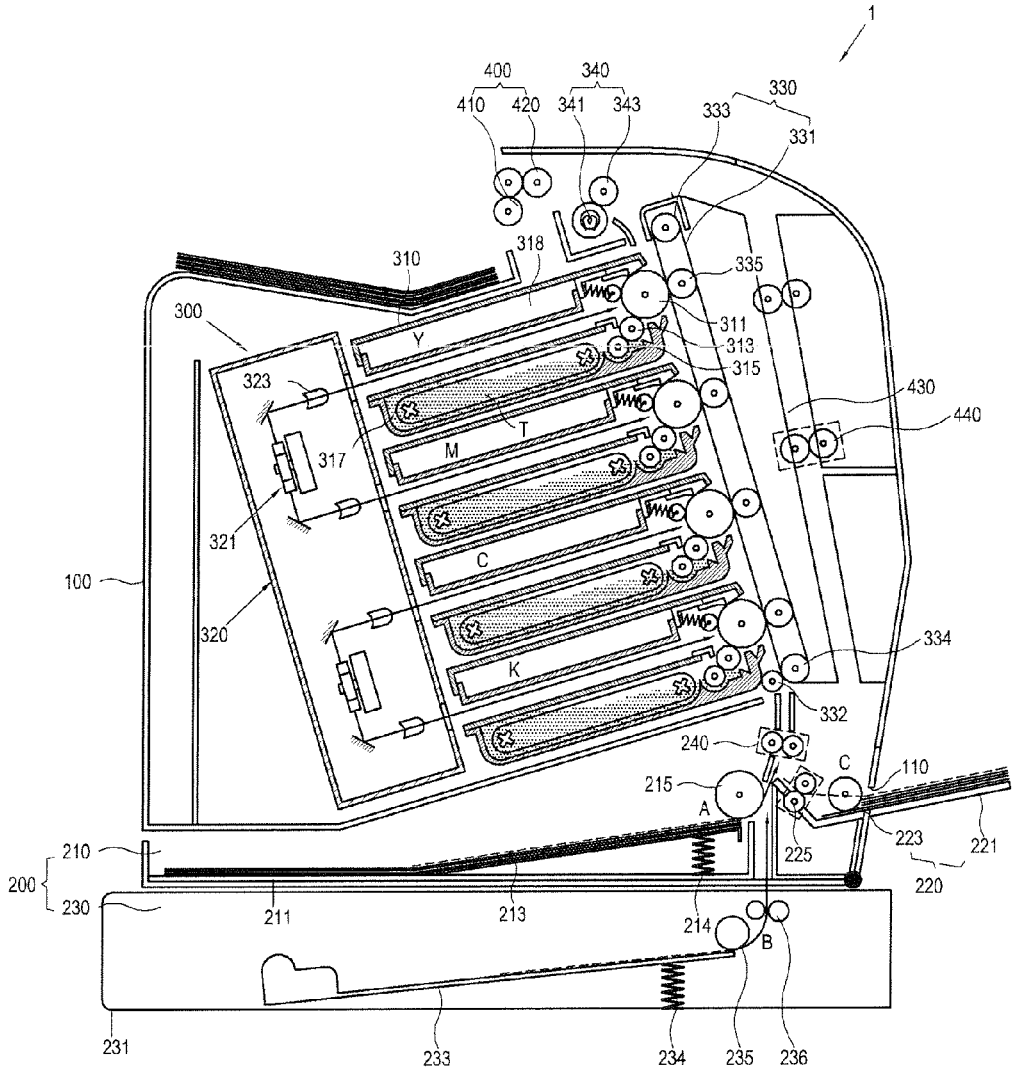
FIG. 2 is a schematic view illustrating a configuration of an image forming apparatus according to an embodiment of the present invention.
Figure 3A:
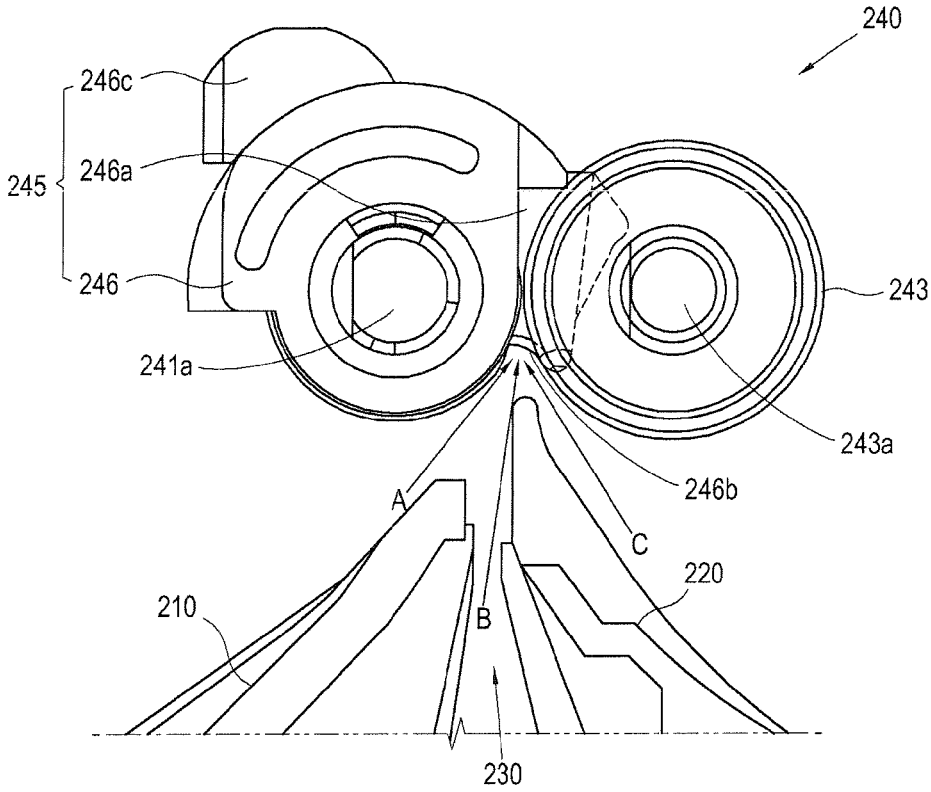
FIGS. 3A and 3B are sectional views illustrating an operating process of a paper aligning roller part shown in FIG. 2.
Figure 3B:
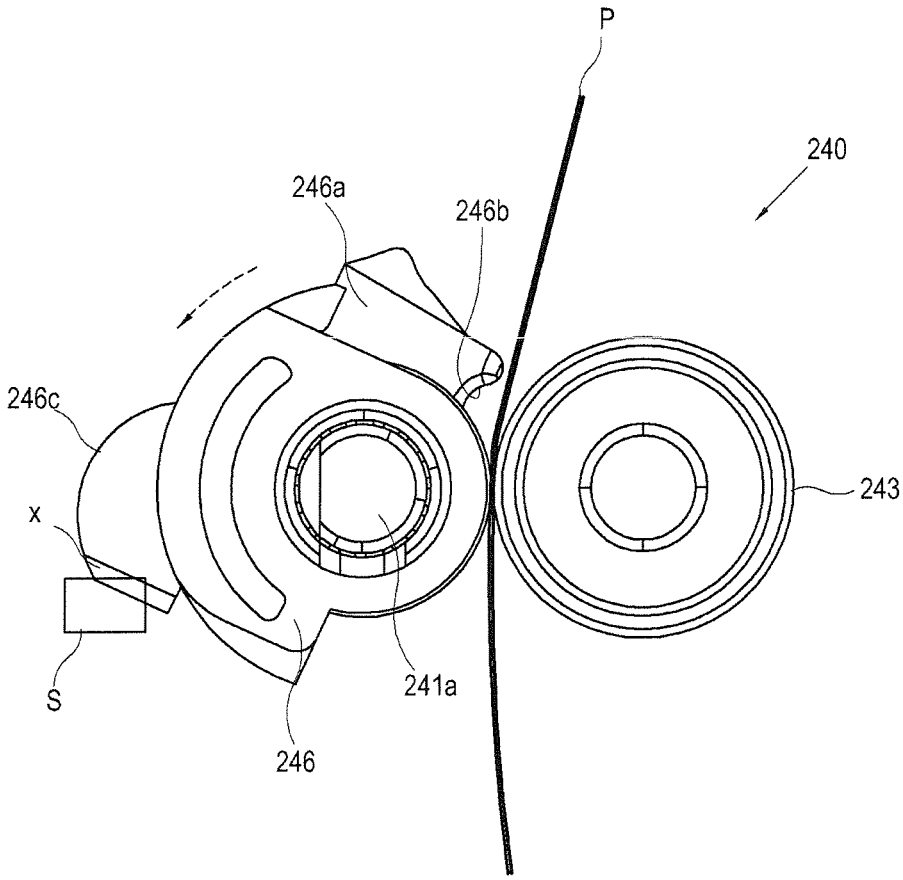

FIG. 2 is a schematic view illustrating a configuration of an image forming apparatus 1 according to an embodiment of the present invention. FIGS. 3A and 3B are sectional views illustrating an operating process of a paper aligning roller part 240 shown in FIG. 2. As shown in FIGS. 2, 3A and 3B, the image forming apparatus 1 according to an embodiment of the present invention includes a feeding apparatus 200 which stores printing media P, such as sheets of paper, transparency sheets, stationary, letterhead, etc., and individually feeds one of the printing media P to an image forming part 300, the image forming part 300 which forms an image on the printing medium P fed from the feeding apparatus 200, a discharging part 400 which discharges the printing medium P on which the image is formed by the image forming part 300, and a casing 100 which accommodates the feeding apparatus 200, the image forming part 300, and the discharging part 400. It is understood that aspects of the present invention are not limited to being applied to an image forming apparatus having the "C" shape feeding path design of the image forming apparatus 1 shown in FIG. 2, and may instead be applied to image forming apparatuses having "S" shape feeding path designs or other designs.

The feeding apparatus 200 according to an embodiment of the present invention includes a first feeding cassette 210 which is detachably attached inside the casing 100 to feed a printing medium P along a feeding path to the image forming part 300 according to a printing signal, a second feeding cassette 220 which is coupled to an external side of the casing 100 to feed another printing medium P to the inside of the casing 100 along another feeding path, and a third feeding cassette 230 which is disposed in a lower part of the first feeding cassette 210 to feed another printing medium P to the image forming part 300 along another feeding path. Also, the feeding apparatus 100 includes the paper aligning roller part 240 which guides each of the printing media P fed from the first, the second, and the third feeding cassettes 210, 220, and 230, respectively, in a reference direction and aligns a leading edge Pf of each of the printing media P moving to the image forming part 300. Hereinafter, it is understood that components which are described using the word "paper," such as the paper aligning roller part 240 and the paper transfer part 230, are not limited to being used with paper, and may instead be used with many different types of printing media P, such as transparency sheets, envelopes, recycled paper, etc.

The first feeding cassette 210 includes a first feeding cassette main body 211 which is attachably detachable to and from the casing 100, a first knock-up plate 213 which is disposed in the first feeding cassette main body 211 to support a stack of the printing media P stacked on an upper side of the knock-up plate 213, a first pick-up roller 215 which individually picks up the sheets of printing media P stacked on the first knock-up plate 213 and transfers the printing medium P to the outside of the first feeding cassette main body 211, and a first elastic member 214 which elastically presses the first knock-up plate 213 toward the first pick-up roller 215. The first feeding cassette main body 211 may be attached and detached to the casing 100 using many different types of components, such as screws, fasteners, adhesives, grooved tracks, etc.

The second feeding cassette 220 is rotationally coupled to the outside of the casing 100. When the printing media P stored in the first feeding cassette 210 and the third feeding cassette 230 are depleted, or when a user desires to print an image on a type of printing medium P having a different size and/or different characteristics from the size and/or the characteristics of the printing media P stored in the first feeding cassette 210 and the third feeding cassette 230, the second feeding cassette 220 may be rotated downwards and the desired type of printing medium P may be fed into the image forming apparatus 1 at an opening 110 using the second feeding cassette 220. For example, a user may use the second feeding cassette 220 to print images on recycled paper, an overhead projector film (OHP), a sheet of paper to develop a photo, an envelope, a postcard, and various other types of printing media P.

The second feeding cassette 220 includes a second feeding cassette main body 221 which is rotationally coupled to the casing 100, a second pick-up roller 223 which is located towards an opening in a side of the casing 100 adjacent to the second feeding cassette main body 221 to pick up the printing media P stored in the second feeding cassette main body 221, and at least one second transferring roller 225 which transfers the printing medium P picked up by the second pick-up roller 223 to the paper aligning roller part 240. According to an aspect of the present invention, the second feeding cassette 220 includes a pair of the transferring rollers 225, as shown in FIG. 2. However, it is understood that one or more than two transferring rollers 225 may instead be used.

The third feeding cassette 230 is disposed on a lower side of the first feeding cassette 210. The third feeding cassette 230 may be used for a variety of purposes, for example, to feed the printing media P to the image forming part 300 if the printing media P stored in the first feeding cassette 210 are depleted. The third feeding cassette 230 includes a third feeding cassette main body 231, a third knock-up plate 233, a third pick-up roller 235, and a third elastic member 234. Also, the third feeding cassette 230 includes a third transferring roller 236 which guides the printing media P picked up by the third pick-up roller 235 to the paper aligning roller part 240. The third transferring roller 236 is disposed in an area between the third pick-up roller 235 and the paper aligning roller part 240 to smoothly transfer sheets of the printing media P stacked on the third knock-up plate 233 around a sharp curve at a bottom area of the image forming apparatus 1. While the image forming apparatus 1 according to an embodiment of the present invention uses a first, second, and third feeding cassette 210, 220 and 230, respectively, aspects of the present invention may be used with image forming apparatuses which have more or less than three feeding cassettes. Furthermore, aspects of the present invention are not limited to being used with image forming apparatuses, and may instead be applied to any type of machine which transfers a printing medium P or any other kind of thin sheet.

Figure 4A:
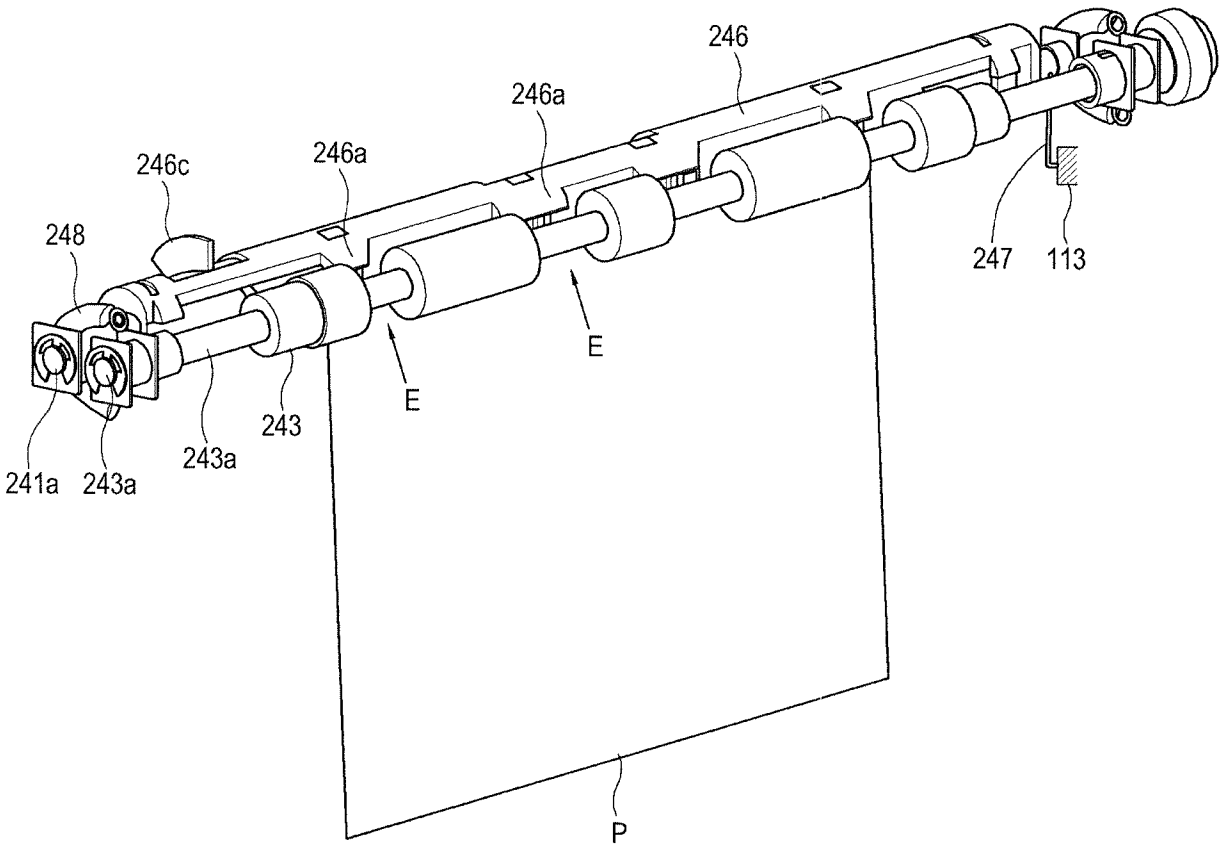
FIGS. 4A and 4B are perspective views illustrating a configuration of the paper aligning roller part shown in FIG. 2.

The paper aligning roller part 240 guides a leading edge Pf of the printing media P fed from each of the feeding cassettes 210, 220, and 230 in the reference direction, and supplies the aligned printing media P to the image forming part 300. As shown in FIGS. 3A, 3B and 4A, the paper aligning roller part 240 includes a driving roller 243 which rotates according to a printing signal, an idle roller 241 which rotates due to friction with the rotation of the driving roller 243, and an aligning shutter 245 which is coupled to a rotational shaft 241 a of the idle roller 241, rotates from the pressure of the moving printing medium P, and aligns the leading edge Pf of the printing medium P.

According to an aspect of the present invention, a plurality of the driving rollers 243 is attached to the rotational shaft 243*a* at predetermined intervals from each other. Additionally, a plurality of the idle rollers 241 is attached to another rotational shaft 241*a* to correspond to the plurality of the driving rollers 243. Each of the driving rollers 243 presses against the corresponding idle roller 241 due to an elastic force generated by a roller pressing member 248. According to an aspect, the roller pressing member 248 is embodied as a spring. However, it is understood that the roller pressing member 248 is not limited to being a spring, and may instead be any type of device capable of pressing the driving rollers 243 into the corresponding idle rollers 241, such as a hydraulic or pneumatic device. The roller pressing member 248 forms a nip having predetermined thickness between each of the driving rollers 243 and the corresponding idle rollers 241. The sheets of the printing media P are transferred through the paper aligning roller part 240 to the image forming part 300 by a frictional force generated at the nip. It is understood that the paper aligning roller part 240 is not required to employ a plurality of driving rollers 243 and corresponding idle rollers 241, and may instead employ one driving roller 243 and corresponding idle roller 241.

The aligning shutter 245 includes a shutter main body 246 which is rotationally coupled to the rotational shaft 241*a* of the idle roller 241, and an elastic member 247 which is coupled to both the shutter main body 146 and a main body frame 113 of the image forming apparatus 1 and which applies a repulsive force against the printing medium P being transferred through the paper aligning roller part 240, so that the printing medium P rotates the shutter main body 246 by applying a pressure greater than a reference pressure to the shutter main body 246. The shutter main body 246 is disposed to cover a predetermined area of an outer surface of the idle roller 241, and to rotate counterclockwise by the pressure of the moving printing medium P. As shown in FIG. 4A, the shutter main body 246 includes a paper aligning boss 246*a* which extends to an area E between sides of the driving rollers 243 when the printing medium P is not moving through the paper aligning roller part 240. The shutter main body 246 contacts the printing medium P before the printing medium P contacts the nip formed between the idle roller 241 and the driving roller 243. The paper aligning boss 246*a* extends from the shutter main body 246 to a downward direction of the nip to contact the printing medium P fed from one of the feeding cassettes 210, 220, and 230.

A paper guiding surface 246*b*, also known as a bottom surface, is disposed on the lower side of the paper aligning boss 246*a* to guide the leading edge Pf of the printing medium P fed from one of the plurality of feeding cassettes 210, 220, and 230 in the reference direction. Hereinafter, although the paper guiding surface will be generally referred to as 246*b*, it is understood that other embodiments of the paper guiding surface, such as 246*b*', 246*b*", and 246*b*"', shown in FIGS. 5B, 5C, and 5D, respectively, may instead be employed as the paper guiding surface. As shown in FIGS. 3A and 3B, a bottom edge of the paper guiding surface 246*b* is located between a side of the shutter main body 245 coupled to the rotational shaft 241 and another side of the shutter main body 245 opposite the one side, and is recessed at a lower side of the paper aligning boss 246*a* to guide the leading edge Pf of the printing medium P fed from various angles in the reference direction. The reference direction is a direction substantially parallel to the nip formed between the driving roller 243 and the idle roller 241. The paper guiding surface 246*b* guides the printing media P fed from the first feeding cassette 210, the second feeding cassette 220, and the third feeding cassette 230, which each approach the nip at different angles, in the reference direction towards the nip to align the leading edge Pf of each of the printing media P.

Figure 5A:
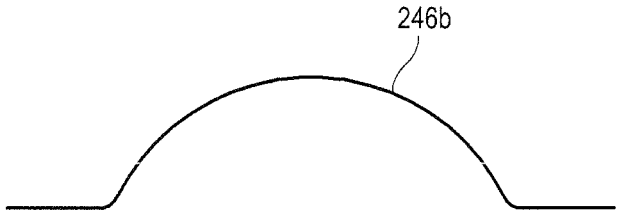
FIGS. 5A, 5B, 5C and 5D are exemplary views illustrating various embodiments of a guiding surface of a shutter main body.
Figure 5B:
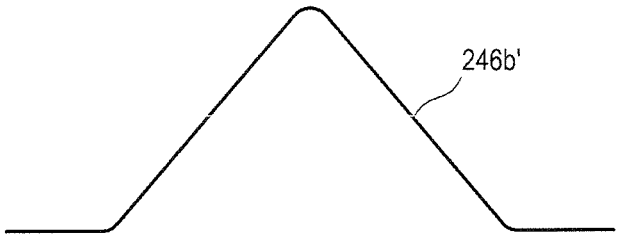
Figure 5C:
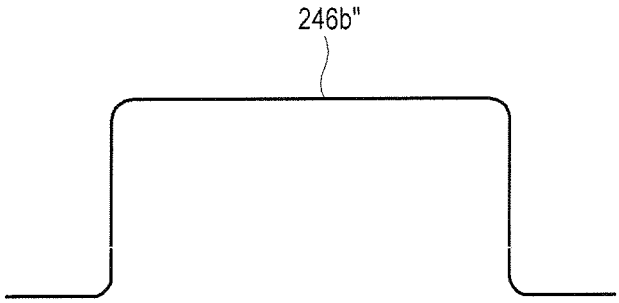
Figure 5D:
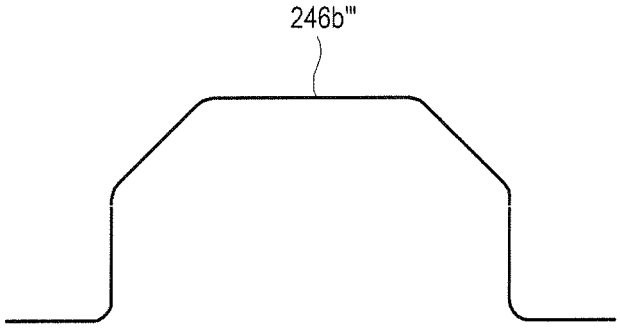

FIGS. 5A, 5B, 5C and 5D illustrate four exemplary shapes of the paper guiding surface 246*b*, 246*b*', 246*b*", and 246'", respectively. The paper guiding surface 246*b* has a curved surface, as shown in FIG. 5A. The paper guiding surfaces 246*b*', 246*b*", and 246*b*'" are shaped in various types of polygonal shapes, including a triangular shape 246*b*' shown in FIG. 5B, a rectangular shape 246*b*" shown in FIG. 5C, and a pentagonal shape 246*b*'" shown in FIG. 5D. It is understood that there are many other types of shapes which the paper guiding surface may have in addition to the four shapes 246*b*, 246*b*', 246*b*", and 246*b*'" shown in FIGS. 5A, 5B, 5C and 5D, respectively, such as a shape which is a combination of straight lines and curves. Generally, when the paper guiding surface is formed similar to the paper guiding surface 246*b* with a primarily a curved shape, the paper guiding surface 246*b* smoothly guides the leading edges Pf of the printing media P in the reference direction.

A flag 246*c* is disposed on one side of the shutter main body 246. The flag 246*c* swings within a path of a sensor S to indicate to the sensor S whether the shutter main body 246 is rotating. If the shutter main body 246 is rotated by the pressure of the moving printing medium P, as shown in FIG. 3B, the sensor S senses an end part x of the flag 246*c* which is rotated into the path of the sensor S by the rotation of the shutter main body 246. When the sensor S senses the rotation of the shutter main body 246, the sensor S transmits a message indicating that the shutter main body 246 is rotating to a controller (not shown). Then, the controller (not shown) controls an exposure part 320 to form an electrostatic latent image in a photosensitive medium 311 of a developing unit 310.

The elastic member 247 applies an elastic force to the shutter main body 246 so that the shutter main body 246 applies a repulsive force against a leading edge Pf of the printing medium P when the printing medium P presses the paper guiding surface 246*b*. The elastic member 247 enables the shutter main body 246 to rotate around the rotational shaft 241 a, and thereby enables the printing medium P to contact the nip if the pressure applied to the shutter main body 246 by the moving printing medium P exceeds the reference pressure. If the leading edge Pf of the moving printing medium P is not aligned, the moving printing medium P does not apply enough pressure to the shutter main body 246 to overcome the reference pressure and rotate the shutter main body 246. Thus, the elastic member 247 applies a repulsive force to the sheet of the printing media P to align the leading edge Pf of the printing medium P.

Figure 4B:
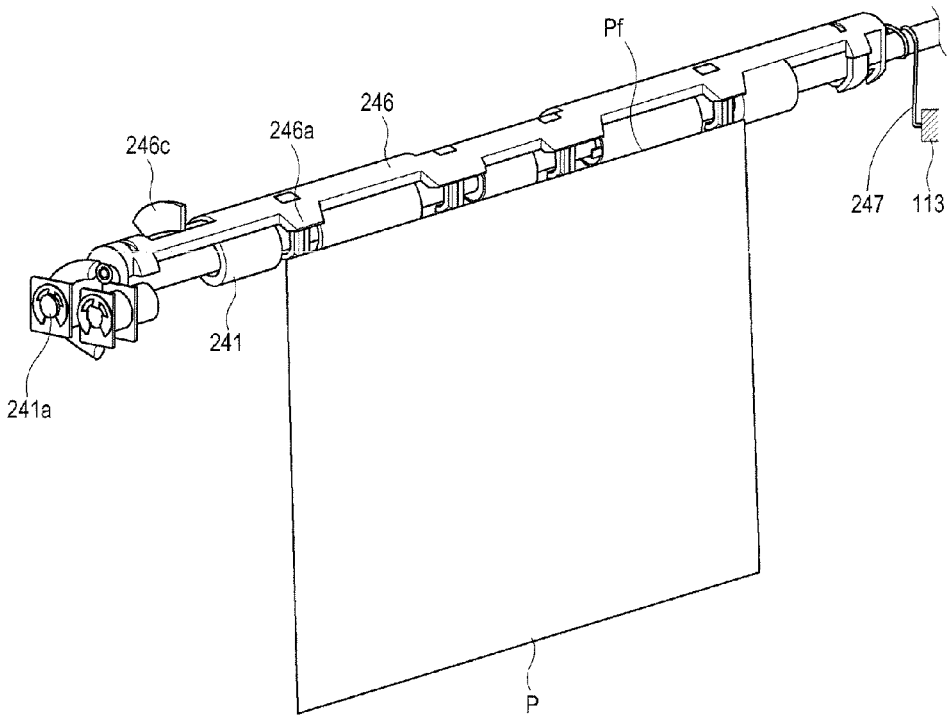

The reference pressure is adjusted to be substantially equal to the pressure applied to the paper guiding surface 246*b* of the shutter main body 246 when the leading edge Pf of the printing medium P is aligned and contacts the shutter main body 246 during the transferring process. The reference pressure may be adjusted by changing various characteristics of the elastic member 247, including, for example, the elastic coefficient, the size, and the thickness of the elastic member 247. As shown in FIG. 4B, the elastic member 247 according to an aspect of the present invention is embodied as a torsion spring 247. One end part of the torsion spring 247 is coupled to the shutter main body 246, and another end part opposite the one end part is coupled to the frame 113 of the casing 100. However, it is understood that the elastic member 247 is not required to be a torsion spring 247, and may instead be another type of spring or any other type of biasing device.

The image forming part 300 forms the image on the printing medium P transferred after the leading edge Pf of the printing medium P is aligned by the paper aligning roller part 240. The image forming part 300 may employ various devices to form an image on the printing medium P, such as an ink jetting device which jets ink to form the image, an electrophotographic device which selectively spreads developer T on the printing medium P by using an electric potential between a photosensitive medium and developer to form the image, or a thermal transfer device which heats and presses an ink ribbon coated with ink and transfers the ink to the printing medium P to form the image.

As shown in FIG. 2, the image forming part 300 according to an embodiment of the present invention employs a color electrophotographic device to form an image on the printing medium P. The image forming part 300 includes the developing unit 310 corresponding to each of four colors in order to form a full-color image in a single-pass process where the printing medium P moves through the image forming part 300 once. Specifically, the image forming part 300 includes four developing units 310 corresponding to the four colors yellow (Y), magenta (M), cyan (C), and black (K). It is understood that the image forming part 300 is not limited to having four developing units 310, and may instead have other combinations of developing units 310, for example, three developing units 310 corresponding to red (R), green (G), and blue (B).

The image forming part 300 includes the plurality of developing units 310 which spread each respective color of developer T to the printing medium P fed from the paper aligning roller part 240, the exposure part 320 which scans a light beam onto a surface of each of the photosensitive media 311 corresponding to the developing units 310 to form electrostatic latent images, a plurality of transfer rollers 335 corresponding to the developing units 310 to transfer the developer T spread on each of the photosensitive media 311 to the printing medium P, a paper transfer part 330 which transfers the printing medium P past the plurality of the developing units 310, and a fusing part 340 which fuses the developer T spread onto the printing medium P by the developing units 310 onto the printing medium P.

Each of the developing units 310 includes the photosensitive medium 311, embodied as, for example, a photosensitive drum 311, which spreads developer T onto the printing medium, developer storing part 317 and 318 which store the developer T in the inside of the developing unit 310, a developing roller 313 which develops the developer T onto the electrostatic latent image of the photosensitive medium 311, and a supplying roller 315 which supplies the developer T to the developing roller 313. A detailed description of the configuration of each the developing units 310 is omitted since the configuration is the same as the configuration of a conventional developing unit.

The exposure part 320 scans a light beam onto each of the photosensitive media 311 disposed in each of the plurality of developing units 310 to form an electrostatic latent image corresponding to each of the four colors. The exposure part 320 is configured so that a plurality of laser beams may be scanned onto a corresponding plurality of the photosensitive media 311 simultaneously. Each of the exposure parts 320 includes a light source (not shown), a polygon mirror 321 which deflects the light beams illuminated from the light source, and an f-θ lens 323 which focuses the light beams deflected by the polygon mirrors 321 onto a scanning surface of the respective photosensitive media to form an electrostatic latent image. Here, the light source (not shown) may be embodied to have a plurality of radiating points, or to have a semiconductor member having a singular radiating point which corresponds to each of the four colors. As shown in FIG. 2, the image forming apparatus 1 includes a pair of the polygon mirrors 321, and each of the polygon mirrors 321 deflects two light beams illuminated from the light source onto different paths. One of the f-θ lens 323 is disposed on each of the four paths which a respective light beam is deflected onto by one of the polygon mirrors 321. Accordingly, the light beams are separately scanned to each of the plurality of photosensitive bodies 311.

A transfer roller 335 is disposed across from each of the photosensitive media 311 so that the printing medium P transferred by a paper transfer belt (PTB) 331 moves in between each of the photosensitive media 311 and the corresponding transfer roller 335. Also, the transfer roller 335 applies a predetermined transfer voltage to a rear side of the printing medium P to transfer the developer spread on the surface of the photosensitive media 311 to the printing medium P. The transfer roller 335 calculates an electrical resistance of the printing medium P based on a thickness and a quality of the printing medium material to apply an optimum transfer voltage to the printing medium P.

The paper transfer part 330 transfers the printing medium P through the image forming apparatus 1 so that the photosensitive media 311 sequentially spread developer T onto the printing medium P to form a color image on the printing medium P. The paper transfer part 330 includes a paper transfer belt (PTB) 331 which uses an electrostatic attractive force to pick up the printing medium P on a surface of the PTB 331, belt driving rollers 333 and 334 which drive the PTB 331, and a belt electrifying roller 332 which electrifies the surface of the PTB 331. A detailed description of a configuration of the paper transfer part 330 will be omitted since the paper transfer part 330 has the same configuration as the configuration of a conventional paper transfer part.

The fusing part 340 applies heat and pressure to the printing medium P to fuse the developer applied by the developing units 310 on the surface of the printing medium P. The fusing part 340 includes a heating roller 341 which applies heat to the printing medium P, and a pressing roller 343 facing the heating roller 341 which presses the printing medium P into the heating roller 341.

After the fusing part 340 fuses the image to the printing medium P during the fusing process, the discharging part 400 discharges the printing medium P to the outside of the casing 100. The discharging part 400 includes a discharging roller 410 which discharges the printing medium P to the outside of the casing 100 and a reverse roller 420 which reverses the transferring direction of the printing medium P according to whether a user has input a signal to print images on both sides of the printing medium P. If a user has input the signal to print images on both sides of the printing medium P, the reverse roller 420 reverses the transferring direction of the printing medium P and transfer the printing medium P to an auxiliary printing part 430. The auxiliary printing part 430 includes at least one pair of auxiliary rollers 440 to transfer the printing medium P back towards the paper transfer part 330.

An operating process of the image forming apparatus 1 according to an embodiment of the present invention will be described by referring to FIGS. 2, 3A, 3B, 4A and 4B.

First, if a user transmits a printing signal from a host apparatus (not shown), the feeding unit 200 feeds the printing medium P to the image forming part 300. The feeding unit 200 feeds the printing medium P stored in one of the feeding cassettes 210, 220 and 230 to the image forming part 300. If the user selects one of the feeding cassettes 210, 220 and 230 as the feeding cassette to supply the printing medium P, the feeding unit 200 feeds the printing medium P through the host apparatus from the selected feeding cassette. Otherwise, if the user does not select one of the feeding cassettes 210, 220 and 230, one of the feeding cassettes may be preset as the default feeding cassette to feed the printing medium P to the image forming part 300.

If the printing medium P is fed from the first feeding cassette 210, the printing medium P enters the paper aligning roller part 240 along the path indicated by the arrow A shown in FIG. 3A. At this time, the leading edge Pf of the printing medium P initially contacts the internal area of the paper guiding surface 246*b*, but is then guided in the recessed central reference direction according to the curved shape of the paper guiding surface 246*b*. The leading edge Pf of the printing medium P presses into the paper guiding surface 246*b* due to a transferring force supplied by the first pick-up roller 215. At this time, the elastic member 247 applies an elastic force to the shutter main body 246 in response to the pressure of the moving printing medium P, and the shutter main body 246 applies a repulsive force to the leading edge Pf of the printing medium P. If the leading edge Pf of the printing medium P is not aligned, the first pick-up roller 215 continues supplying a transferring force to the printing medium P until the leading edge Pf becomes aligned, increasing the pressure transmitted to the paper guiding surface 246*b*. Accordingly, the paper guiding surface 246*b* aligns the leading edge Pf of the printing medium P.

If the leading edge Pf of the printing medium P is aligned, the printing medium P is moving in the reference direction of the paper guiding surface 246*b*, and the pressure applied to the paper guiding surface 246*b* exceeds the reference pressure, the shutter main body 246 rotates counterclockwise as shown in FIG. 3B. Accordingly, the leading edge Pf of the printing medium P enters the nip formed at a common contact area between the idle roller 241 and the driving roller 243.

The printing medium P fed from the second feeding cassette 220 enters the aligning shutter 245 along a path indicated by the arrow C in FIG. 3A. As the printing medium P moving along the path indicated by the arrow C contacts the paper guiding surface 246, the shape of the paper guiding surface 246*b* guides the printing medium P in the reference direction. At this point, the leading edge Pf of the printing medium P moving in the path indicated by the arrow C is aligned through the same process as the printing medium P fed from the first feeding cassette 210 moving along the path indicated by the arrow A.

The printing medium P fed from the third feeding cassette 230 moves in a direction indicated by the arrow B in FIG. 3A. As the printing medium P fed from the third feeding cassette 230 contacts the paper guiding surface 246*b*, the printing medium P is aligned and guided in the reference direction according to the same process as the above-described processes for the printing media P supplied from the first and second feeding cassettes 210 and 220.

As described above, the printing media P fed from each of the feeding cassettes 210, 220, and 230 are supplied to the image forming part 300 with aligned leading edges Pf. The printing media P are further guided in the reference direction, which avoids paper jams and other problems.

When the printing medium P rotates the shutter main body 246, the rotation of the shutter main body 246 rotates the flag 246*c* into a path of the sensor S. At this point, the sensor S transmits a message to a controller (not shown) indicating that the printing medium P is moving towards the image forming part 300. Thus, the aligning shutter 245 according to aspects of the present invention enables the controller to accurately control the exposure part 330 to form the electrostatic latent image on the photosensitive media 311.

The PTB 331 picks the printing medium P up onto a surface of the PTB 331 using an electrical attraction, and then transfers the printing medium P past each of the photosensitive media 311. Accordingly, each color of the developer T is applied to the surface of the printing medium P, and the image is then fused to the printing medium P by heat and pressure supplied from the fusing part 340.

Figure 1B:
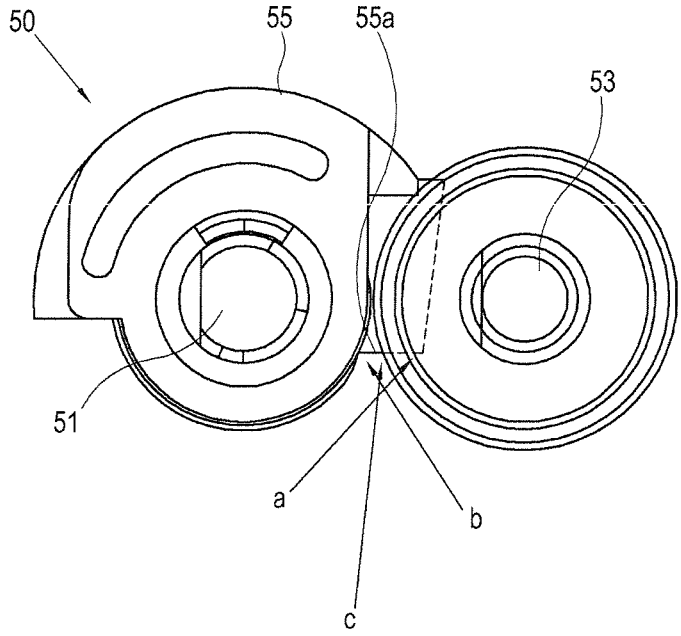
FIG. 1B (RELATED ART)
FIG. 1B is a sectional view illustrating a configuration of a conventional paper aligning roller part shown in FIG. 1A.

As described above, the image forming apparatus according to aspects of the present invention smoothly transfers printing media P from the first, second, and third feeding cassettes 210, 220 and 230 to the image forming part 300, since the printing media P are guided in the reference direction by the paper guiding surface 246*b*, even if the printing media P are initially transferred to the paper aligning roller part 240 from directions deviating from the reference direction. Accordingly, the image forming apparatus according to aspects of the present invention solves the conventional problem that the printing media P become misaligned by impacting the shutter 55 (FIG. 1B).

Also, the paper aligning roller part 240 according to aspects of the present invention aligns the printing media P using one simple aligning roller part 240, thereby aligning the printing media using a device with a simple configuration.

Furthermore, although the above-described embodiments of the present invention have been described as using an image forming apparatus 1 having three feeding cassettes 210, 220 and 230, aspects of the present invention may be applied to an image forming apparatus having more or less than three feeding cassettes. Additionally, aspects of the present invention are not limited to being applied to the image forming apparatus 1, and may be applied to any device which transfers sheets of material.

As described above, the paper feeding apparatus 200 and the image forming apparatus 1 according to aspects of the present invention guide the leading edge Pf of printing media P fed from different directions in a reference direction. Accordingly, the direction in which pressure is applied from the leading edge Pf of the printing medium P to the aligning shutter 245 is maintained in a constant direction, thereby enhancing an aligning efficiency of the leading edge Pf of the printing medium P.

Furthermore, since the paper feeding apparatus 200 and the image forming apparatus 1 according to aspects of the present invention enhances the aligning efficiency of the leading edge Pf of the printing medium P, a uniform color distribution is also obtained, thereby improving printing quality.

Moreover, the aligning shutter 245 according to aspects of the present invention does not jam sheets of the printing media P which are moving in a direction deviated from the reference direction, thereby preventing wrinkling of the printing media P and an inferior transfer of the printing media P compared to the conventional aligning shutter 55.

Furthermore, the guiding surface 246*b* having a curved surface minimizes an impact applied to the printing medium P when the printing medium P contacts to guiding surface 246*b*, thereby preventing the printing medium P from deviating away from the reference direction due to the impact.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A printing medium feeding apparatus comprising:

a feeding part which feeds a printing medium; and a printing medium aligning roller part which aligns a leading edge of the printing medium fed from the feeding part and transfers the aligned printing medium to an image forming part which forms an image on the printing medium, wherein the printing medium aligning roller part comprises:

a pair of rollers which transfer the printing medium to the image forming part, and an aligning shutter which is rotationally coupled to one of the pair of the rollers, rotates according to whether the printing medium contacts the aligning shutter with a pressure greater than a reference pressure in a reference direction, and guides the leading edge of the printing medium fed from the feeding part toward the reference direction, wherein the feeding part comprises a plurality of feeding cassettes which feed a first printing medium from a first direction and a second printing medium from a different second direction to the printing medium aligning roller part, wherein the aligning shutter comprises:

a shutter main body which is rotationally coupled to a rotational shaft of the roller to which the aligning shutter is rotationally coupled to, and a guiding surface which protrudes from one side of the shutter main body to contact the leading edge of the first printing medium and the leading edge of the second printing medium and guide the respective leading edges of the first and the second printing mediums in the same reference direction, wherein the guiding surface has a semicircular, concave shape so that the leading edges of the first and the second printing mediums are smoothly guided in the same reference direction by the semicircular, concave shape.

2. The printing medium feeding apparatus according to claim 1, wherein the aligning shutter further comprises:

an elastic member which applies the reference pressure to the shutter main body so that the shutter main body rotates around the rotational shaft of the roller according to whether the pressure of the printing medium applied to the guiding surface exceeds the reference pressure.

3. The printing medium feeding apparatus according to claim 1, further comprising:

a flag disposed on the aligning shutter; and a sensor disposed in a rotational path of the flag, wherein when the aligning shutter rotates due to the printing medium contacting the aligning shutter with the pressure greater than the reference pressure, the flag rotates past the sensor to indicate that the printing medium is moving towards the image forming part.

4. The printing medium feeding apparatus according to claim 2, wherein the elastic member comprises a torsion spring.

5. An image forming apparatus, comprising:

a printing medium feeding apparatus comprising:

a feeding part which feeds a printing medium; and a printing medium aligning roller part which aligns a leading edge of the printing medium fed from the feeding part and transfers the aligned printing medium to an image forming part which forms an image on the printing medium, wherein the printing medium aligning roller part comprises:

a pair of rollers which transfer the printing medium to the image forming part, and an aligning shutter which is rotationally coupled to one of the pair of the rollers, rotates according to whether the printing medium contacts the aligning shutter with a pressure greater than a reference pressure in a reference direction, and guides the leading edge of the printing medium fed from the feeding part toward the reference direction;

the image forming part which forms the image on the printing medium fed from the printing medium feeding apparatus; and a discharging part which discharges the printing medium on which the image is formed to an outside of the image forming apparatus, wherein the feeding part comprises a plurality of feeding cassettes which feed a first printing medium from a first direction and a second printing medium from a different second direction to the printing medium aligning roller part, wherein the aligning shutter comprises:

a shutter main body which is rotationally coupled to a rotational shaft of the roller to which the aligning shutter is rotationally coupled to, and a guiding surface which protrudes from one side of the shutter main body to contact the leading edge of the first printing medium and the leading edge of the second printing medium and guide the respective leading edges of the first and the second printing mediums in the same reference direction, wherein the guiding surface has a semicircular, concave shape so that the leading edges of the first and the second printing mediums are smoothly guided in the same reference direction by the semicircular, concave shape.

6. The image forming apparatus according to claim 5, wherein the aligning shutter further comprises:

an elastic member which applies the reference pressure to the shutter main body so that the shutter main body rotates around the rotational shaft of the roller according to whether the pressure of the printing medium applied to the guiding surface exceeds the reference pressure.

7. A printing medium aligning unit, comprising:

a pair of rollers which transfer a printing medium supplied from a printing medium feeding cassette; and an aligning shutter to align the printing medium, comprising:

one side which is rotationally coupled to one of the pair of rollers, another side opposite the one side, and a bottom surface between the one side and the another side, wherein the bottom surface has a semicircular, concave shape and contacts a leading edge of the printing medium when the printing medium is transferred to smoothly guide the printing medium by towards the semicircular, concave shape and thereby transfers the printing medium in a reference direction.

8. The printing medium aligning unit according to claim 7, further comprising:

a flag disposed on the aligning shutter; and a sensor disposed in a rotational path of the flag, wherein when the aligning shutter rotates due to the printing medium contacting the aligning shutter, the flag rotates past the sensor to indicate that the printing medium is being transferred past the pair of rollers.

9. The printing medium aligning unit according to claim 7, further comprising an elastic member which is coupled to the aligning shutter and a frame of an image forming apparatus and which supplies a reference pressure to the aligning shutter, wherein the aligning shutter rotates according to whether the printing medium supplies a pressure greater than the reference pressure.

10. The printing medium aligning unit according to claim 9, wherein the elastic member comprises a torsion spring.

11. An image forming apparatus, comprising:

a printing medium feeding cassette to supply a printing medium along a feeding path;

an image forming part to form an image on the printing medium; and a printing medium aligning part, comprising:

a pair of rollers which transfer the printing medium supplied from the printing medium feeding cassette, and an aligning shutter to align the printing medium, comprising:

one side which is rotationally coupled to one of the pair of rollers;

another side opposite the one side; and a bottom surface between the one side and the another side, wherein the bottom surface has a semicircular, concave shape and contacts a leading edge of the printing medium when the printing medium is transferred to smoothly guide the printing medium the semicircular, concave shape and thereby transfer the printing medium in a reference direction.

12. A printing medium aligning unit, comprising:

a pair of rollers which transfer a printing medium supplied from a printing medium feeding cassette; and an aligning shutter to align the printing medium, comprising:

one side which is rotationally coupled to one of the pair of rollers, another side opposite the one side, and a bottom surface between the one side and the another side, wherein the bottom surface having a semicircular, concave shape to smoothly guide a leading edge of the printing medium so that pressure applied to the bottom surface by the leading edge is maintained in a constant direction.

* * * * *

UNITED STATES PATENT AND TRADEMARK OFFICE

CERTIFICATE OF CORRECTION

PATENT NO. : 8,554,124 B2
APPLICATION NO. : 11/956781
DATED : October 8, 2013
INVENTOR(S) : Jin-soo Lee et al.

It is certified that error appears in the above-identified patent and that said Letters Patent is hereby corrected as shown below:

In the Claims

In Column 14, Line 1, In Claim 7, before "the" delete "towards".
In Column 14, Line 36 (Approx.), In Claim 11, after "medium" insert -- by --.

Signed and Sealed this
Twenty-fifth Day of February, 2014

Michelle K. Lee

Michelle K. Lee
*Deputy Director of the United States Patent and Trademark Office*